US006424719B1

(12) United States Patent
Elko et al.

(10) Patent No.: US 6,424,719 B1
(45) Date of Patent: Jul. 23, 2002

(54) ACOUSTIC CROSSTALK CANCELLATION SYSTEM

(75) Inventors: Gary W. Elko, Summit, NJ (US); Darren B. Ward, Canberra (AU)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/363,674

(22) Filed: Jul. 29, 1999

(51) Int. Cl.[7] ..... H04R 5/00
(52) U.S. Cl. ..... 381/1; 381/27
(58) Field of Search ..... 381/1, 303, 27, 381/19, 300, 302, 17–20

(56) References Cited

U.S. PATENT DOCUMENTS 4,199,658 A * 4/1980 Iwahara ..... 381/1
5,068,897 A * 11/1991 Yamato et al. ..... 381/302
5,305,386 A * 4/1994 Yamato ..... 381/1
5,333,200 A * 7/1994 Cooper et al. ..... 381/1

* cited by examiner

*Primary Examiner*—Forester W. Isen
*Assistant Examiner*—Brian Pendleton
(74) *Attorney, Agent, or Firm*—Baker & McKenzie

(57) ABSTRACT

A system for acoustic crosstalk cancellation which uses a loudspeaker arrangement including three loudspeakers, with the center loudspeaker set forward of the two outside loudspeakers. This arrangement increases the bandwidth in which effective cancellation is provided. The system provides a significant gain in performance over conventional crosstalk cancellation systems, which are very sensitive to the position of the listener's head.

5 Claims, 8 Drawing Sheets

$P_L$
$P_R$
110
120
$BPF_1$
$BPF_2$
$BPF_N$
100.1
100.2
100.N
$h_{11}$
$h_{21}$
$h_{12}$
$h_{22}$
$h_{1N}$
$h_{2N}$
$h_{3N}$
$h_{4N}$
$h_{32}$
$h_{42}$
$h_{31}$
$h_{41}$
151
152
153
154
191
181
171
172
182
192
175
161
15

ACOUSTIC CROSSTALK CANCELLATION SYSTEM

FIELD OF THE INVENTION

The present invention relates to audio systems, in particular, "3D" audio systems.

BACKGROUND INFORMATION

Conventional 3D audio systems include: (i) a binaural spatializer, which simulates the appropriate auditory experience of one or more sources located around the listener; and (ii) a delivery system, which ensures that the binaural signals are received correctly at the listener's ears. Much work has been done on binaural spatialization and several commercial systems are currently available.

To achieve good reproduction of 3D audio, it is necessary to precisely control the acoustic signals at the listener's ears. One way to do this is to deliver the audio signals through headphones. In many situations, however, it is preferable not to wear headphones. The use of standard stereo loudspeakers is problematic, since there is a significant amount of left and right channel leakage known as "crosstalk".

Acoustic crosstalk cancellation is a signal processing technique whereby two (or possibly more) loudspeakers are used to deliver 3D audio to a listener, without requiring headphones. The idea is to cancel the crosstalk signal that arrives at each ear from the opposite-side loudspeaker. If this can be successfully achieved, then the acoustic signals at the listener's ears can be controlled, just as if the listener was wearing headphones. A significant problem with existing crosstalk cancellation systems is that they are very sensitive to the position of the listener's head. Although good cancellation can be achieved for the head in a default position, the crosstalk signal is no longer canceled if the listener moves his head; in some cases head movement of only a couple of centimeters can have drastic effects.

With conventional systems, exact cancellation requires perfect knowledge of the acoustic transfer functions (TFs) between the loudspeakers and the listener's ears. These TFs are modeled using an assumed head position and generic head-related transfer functions (HRTFs). (See, for example, D. G. Begault, "3D sound for virtual reality and multimedia," Academic Press Inc., Boston, 1994.) In practice, however, the real TFs will always differ from the assumed model, most noticeably by the listener's head moving from its assumed position. Any variation between the assumed model and the real environment will result in degradation in the performance of the crosstalk canceler: in some cases this performance degradation can be quite severe.

The only way to know the acoustic TFs exactly is to place microphones in the listener's ears and constantly update the crosstalk cancellation network appropriately. (See, e.g., P. A. Nelson et al., "Adaptive inverse filters for stereophonic sound reproduction", *IEEE Trans. Signal Processing,* vol. 40, no. 7, pp. 1621–1632, July 1992.) However it may be preferable to use some form of passive head tracking and adaptively update the cancellation network based on the current position of the listener's head. Methods of passive head tracking include: (i) using a head-mounted head tracker; (ii) using a microphone array to determine the head position based on the listener's giving a spoken command (this may require the user to constantly speak to the system); or (iii) using a video camera. Although use of a video camera appears to be the most promising, even with an accurate camera-based head tracker, it is inevitable that there will still be some position errors in addition to errors between the generic HRTFs and the listener's own HRTFs. For these reasons, such a crosstalk canceler will be non-robust in practice.

FIG. 1 is a generalized block diagram of a conventional crosstalk cancellation system as described in U.S. Pat. No. 3,236,949 to Atal and Schroeder. $p_L$ and $p_R$ are the left and right program signals respectively, $l_1$ and $l_2$, are the loudspeaker signals, and $a_n^R$, n=1, 2 is the transfer function (TF) from the nth loudspeaker to the right ear (a similar pair of TFs for the left ear, denoted by $a_n^L$, are not shown). The objective is to find the filter transfer functions $h_1$, $h_2$, $h_3$, $h_4$ such that: (i) the signals $p_L$ and $p_R$ are reproduced at the left and right ears respectively; and (ii) the crosstalk signals are canceled, i.e., none of the $p_L$ signal is received at the right ear, and similarly, none of the $p_R$ signal is received at the left ear.

Denoting the signals at the left and right ears as $e_L$ and $e_R$ respectively, the block diagram of FIG. 1 may be described by the following linear system:

$$\begin{bmatrix} e_R \\ e_L \end{bmatrix} = \begin{bmatrix} a_1^R & a_2^R \\ a_1^L & a_2^L \end{bmatrix} \begin{bmatrix} h_1 & h_3 \\ h_2 & h_4 \end{bmatrix} \begin{bmatrix} p_R \\ p_L \end{bmatrix} \tag{1}$$

$$e = A\ H\ p.$$

To reproduce the program signals identically at the ears requires that $$H = A^{-1}. \tag{2}$$

For simplicity, only the response to the right program channel will be described. The description for the left channel would be similar. In this case, the block diagram in FIG. 1 reduces to a two-channel beamformer, with filters $h_1$ and $h_2$ on the respective channels.

Let the response at the ears be:

$$\begin{bmatrix} b_R \\ b_L \end{bmatrix} = \begin{bmatrix} a_1^R & a_2^R \\ a_1^L & a_2^L \end{bmatrix} \begin{bmatrix} h_1 \\ h_2 \end{bmatrix} \tag{3}$$

$$b = Ah,$$

where $b_R$=1 (i.e., the right program signal is faithfully reproduced at the right ear), and $b_L$=0 (i.e., none of the right program signal reaches the left ear). Assuming the TF matrix A is known and invertible, then the system of equations (3) can be readily solved to find the required filters h. Typically, the TF matrix A is determined (either from measurements on a dummy head, or through calculations using some assumed head model) for a fixed head location (the "design position"). However, if A varies from its design values, then the calculated filters will no longer produce the desired crosstalk cancellation. In practice, variation of A occurs whenever the listener moves his head or when different listeners use the system. This is a fundamental problem with known acoustic crosstalk cancellation systems.

Robustness to head movements is frequency-dependent, and for a given frequency, there is a specific loudspeaker spacing which gives the best performance in terms of robustness. (See D. B. Ward et al., "Optimum loudspeaker spacing for robust crosstalk cancellation", Proc. IEEE Conf. Acoustic Speech Signal Processing (ICASSP-98), Seattle, May 1998, Vol. 6, pp. 3541–3544.) However, as frequency increases, the loudspeaker spacing required to give good robustness performance becomes impractical. For example, for a head distance of $d_H$=0.5 m (typical for a desktop audio system) and a head radius of $r_H$=0.0875 m, a loudspeaker spacing of approximately 0.1 m is required. For a more practical loudspeaker spacing of 0.25 m, the conventional crosstalk canceler is extremely non-robust at a frequency of 4 kHz, and head movements of as little as 2 cm can destroy the crosstalk cancellation effect. Thus, for a fixed loudspeaker spacing, the conventional crosstalk canceler becomes inherently non-robust at certain frequencies.

Differences between the assumed TF model and the actual TF model can be considered as perturbations of the acoustic TF matrix A of Eq. 3. These differences include movement of the head from its design position, and differences between different HRTFs. From linear systems theory, the robustness of the system of Eq. 3 to perturbation of a symmetric matrix A is reflected by its condition number, defined for A complex as $$cond\{A\} = \frac{\sigma_{\max}\left(\sqrt{AA^H}\right)}{\sigma_{\min}\left(\sqrt{AA^H}\right)} \tag{4}$$

where $_{min}$(x) and $_{max}$(x) represent the smallest and largest singular values respectively. For a two-channel crosstalk canceler, A has only two singular values. When A is ill-conditioned, the crosstalk canceler will be sensitive to variations in head position. Thus, it is important to consider under which configurations the matrix A becomes ill-conditioned.

Consider the following model for the TF from the nth loudspeaker to the right ear:

$$a_n^R = e^{j2\pi fc^{-1}d_n^R}, \qquad n = 1, 2 \tag{5}$$

where c is the speed of sound propagation, and $d_n^R$ is the distance from the nth loudspeaker to the right ear (and similarly for the left ear, $a_n^L$ and $d_n^L$). Note that this model ignores both attenuation from the loudspeaker to the ear, and also the effect of the head on the impinging sound wavefront. Hence, it only models the inter-aural time delay. For most practicable loudspeaker spacings (where the loudspeakers are placed in front of the listener), the inter-aural time delay is almost the same whether the head is modeled as two points in space (as here), or as a sphere (See C. P. Brown et al., "An efficient HRTF model for 3-D sound", in *Proc. IEEE Workshop on Applicat. of Signal Processing to Audio and Acoust.* (WASPAA-97), New Paltz, N.Y., October 1997.)

Assuming that the head is symmetrically positioned between the loudspeakers and that the loudspeakers have identical flat frequency responses, the acoustic TF matrix in Eq. 3 reduces to:

$$A = \begin{bmatrix} a_1^R & a_2^R \\ a_2^R & a_1^R \end{bmatrix} \tag{6}$$

since $a_1^L = a_2^R$ and $a_2^L = a_1^R$.

Let $d_2^R = d_1^R +$. Hence, $$\begin{aligned} a_2^R &= e^{j2\pi fc^{-1}(d_1^R+\Delta)} \\ &= a_1^R e^{j2\pi fc^{-1}\Delta} \end{aligned} \tag{7}$$

-continued $$\text{Hence,} \quad A = a_1^R \begin{bmatrix} 1 & e^{j2\pi fc^{-1}\Delta} \\ e^{j2\pi fc^{-1}\Delta} & 1 \end{bmatrix}, \quad \text{and}$$

$$AA^H = 2|a_1^R|^2 \begin{bmatrix} 1 & \cos(2\pi fc^{-1}\Delta) \\ \cos(2\pi fc^{-1}\Delta) & 1 \end{bmatrix}.$$

Clearly, the matrix $AA^H$ is ill-conditioned for:

$$\cos(2\ fc^{-1}) = \pm 1$$

(in fact, it is singular), or equivalently, $$\Delta = p\frac{c}{2f}, \quad p \in Z \tag{8}$$

This result may be stated as follows: for an acoustically symmetric system, the crosstalk canceler becomes extremely non-robust when the inter-aural path difference is an integer multiple of half the operating wave-length and for frequencies where the wavelength is much larger than the speaker spacing.

If attenuation due to wave propagation or head effects is included in the model for the acoustic TFs, then although A does not become singular when the above condition holds, it is nonetheless ill-conditioned. These attenuation terms have a relatively minor effect on the robustness of the crosstalk canceler, and it is the inter-aural time delay which dominates.

Thus, for a fixed loudspeaker spacing, head distance and head radius, the crosstalk canceler will be robust only for a limited bandwidth. We will refer to the minimum frequency at which the matrix A is ill-conditioned as the critical bandwidth of the crosstalk canceler. In practice, the critical bandwidth represents the frequency at which the crosstalk canceler becomes non-robust, i.e., the frequency at which it "breaks". The crosstalk cancellation system of the present invention has a wider critical bandwidth, thereby providing good crosstalk cancellation over a wider range of frequencies.

Based on Eq. 8, FIG. 2 shows the critical bandwidth of a conventional crosstalk cancellation system as a function of loudspeaker spacing and with a default head radius of rH=0.0875 m. The results for head distances of 0.25 m, 0.5 m and 0.75 m are also shown in FIG. 2.

In view of the foregoing, there is a need for an acoustic crosstalk cancellation system which is robust to head movements.

SUMMARY OF THE INVENTION

The present invention is directed to a robust crosstalk cancellation system.

In an exemplary embodiment of a crosstalk cancellation system in accordance with the present invention, three loudspeakers are used, with a center loudspeaker displaced forward (towards the listener) relative to the two other loudspeakers, which are arranged to the left and right of the center loudspeaker. The loudspeakers are driven by a signal processing circuit which performs crosstalk cancellation at least below a predetermined frequency.

Compared to conventional crosstalk cancellation systems, the system of the present invention is less susceptible to movements of the listener's head over a larger range of frequencies and over a larger range of head movements.

DETAILED DESCRIPTION

Figure 3:
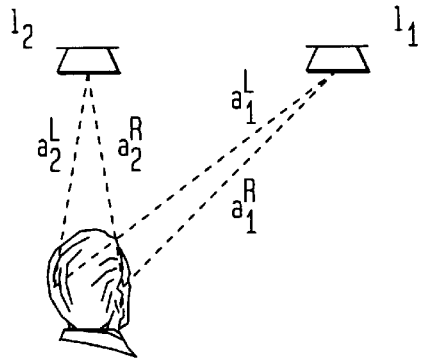
FIG. 3 shows the geometry for asymmetric head positioning.

FIG. 3 shows a loudspeaker arrangement in which the listener's head is positioned asymmetrically with respect to the loudspeakers. In this case, $a_2^L = a_2^R$. Using the TF model given by Eq. 5, the acoustic TF matrix A is given by $$A = \begin{bmatrix} a_1^R & a_2^R \\ a_1^R e^{j2\pi f c^{-1}\Delta} & a_2^R \end{bmatrix}, \quad \text{and} \tag{9}$$

$$AA^H = \begin{bmatrix} |a_1^R|^2 + |a_2^R|^2 & |a_1^R|^2 e^{-j2\pi f c^{-1}\Delta} + |a_2^R|^2 \\ |a_1^R|^2 e^{j2\pi f c^{-1}\Delta} + |a_2^R|^2 & |a_1^R|^2 + |a_2^R|^2 \end{bmatrix}.$$

In this case, $AA^H$ is singular for $$e^{-j2\pi f c^{-1}\Delta} = e^{j2\pi f c^{-1}\Delta}, \quad \text{or equivalently,}$$

$$\Delta = p\frac{c}{f}, \quad p \in Z. \tag{10}$$

This result may be stated as follows: for the acoustically asymmetric system shown in FIG. 3, a crosstalk canceler becomes non-robust when the inter-aural path difference due to the asymmetrically placed loudspeaker is an integer multiple of the operating wavelength and for frequencies where the wavelength is much larger than the speaker spacing.

Comparing Eqs. 8 and 10, it appears that by offsetting the loudspeakers as in FIG. 3, the critical bandwidth is doubled. For a fixed loudspeaker spacing, the inter-aural path difference is increased when the head is offset, compared to a symmetrical head position.

Figure 4:
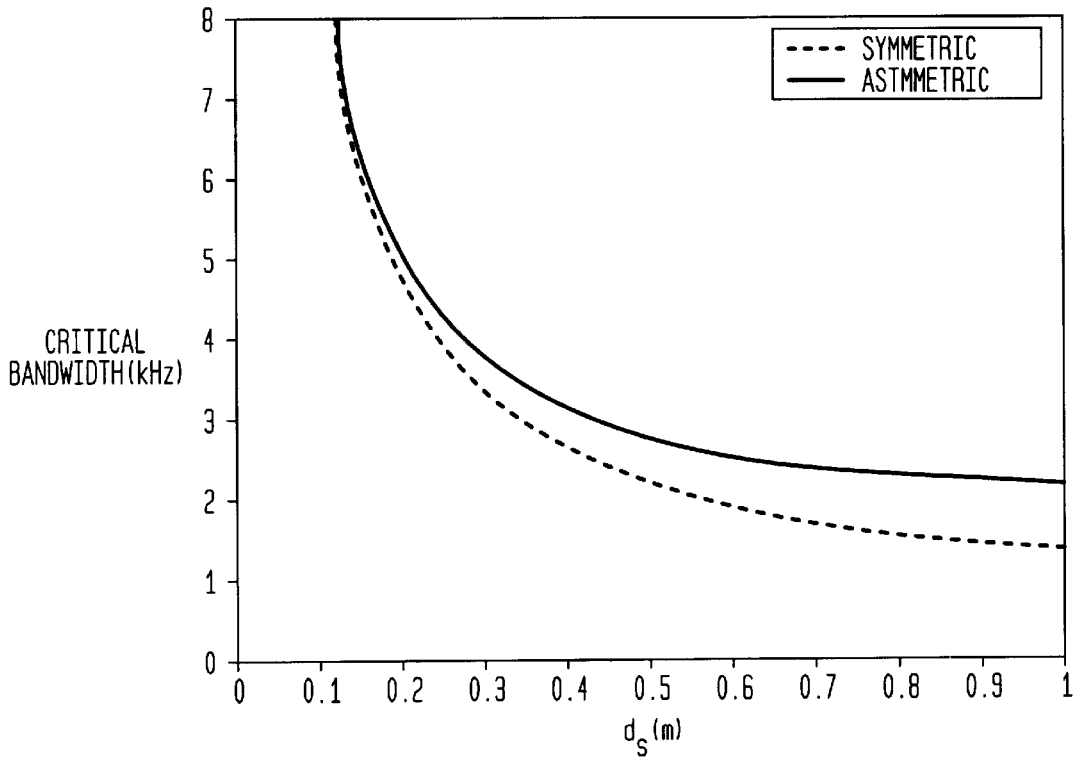
FIG. 4 is a graph of the critical bandwidth of a conventional crosstalk canceler as a function of loudspeaker spacing for symmetric and asymmetric head positioning.

Comparing the critical bandwidths of each geometry illustrates the real gain achieved by offsetting the head. FIG. 4 shows the critical bandwidth of a crosstalk canceler as a function of loudspeaker spacing, for symmetric and asymmetric head positions (with a head distance of 0.5 m). For wide loudspeaker spacings, asymmetric head positioning increases the critical bandwidth significantly. For small loudspeaker spacings, however, the bandwidth gain is smaller.

Figure 5:
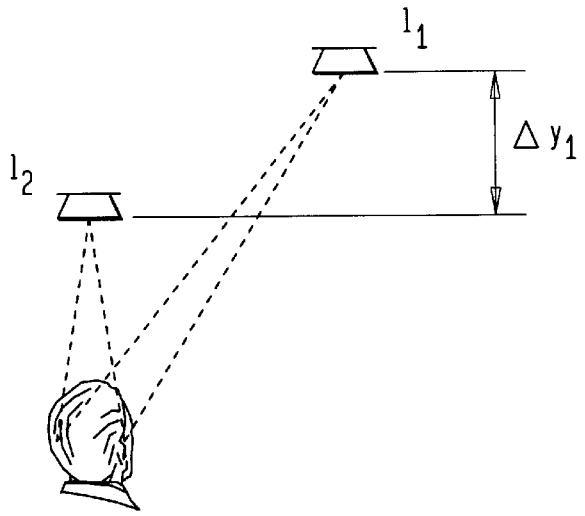
FIG. 5 shows a loudspeaker arrangement in accordance with the present invention.

FIG. 5 shows a loudspeaker arrangement in accordance with the present invention. In the arrangement of FIG. 5, the inter-aural path difference is decreased by moving loudspeaker 1 back, away from the listener. The decrease in the inter-aural path difference results in an increased critical bandwidth. The distance by which loudspeaker 1 is displaced back from loudspeaker 2 is indicated as $y_1$.

Figure 6:
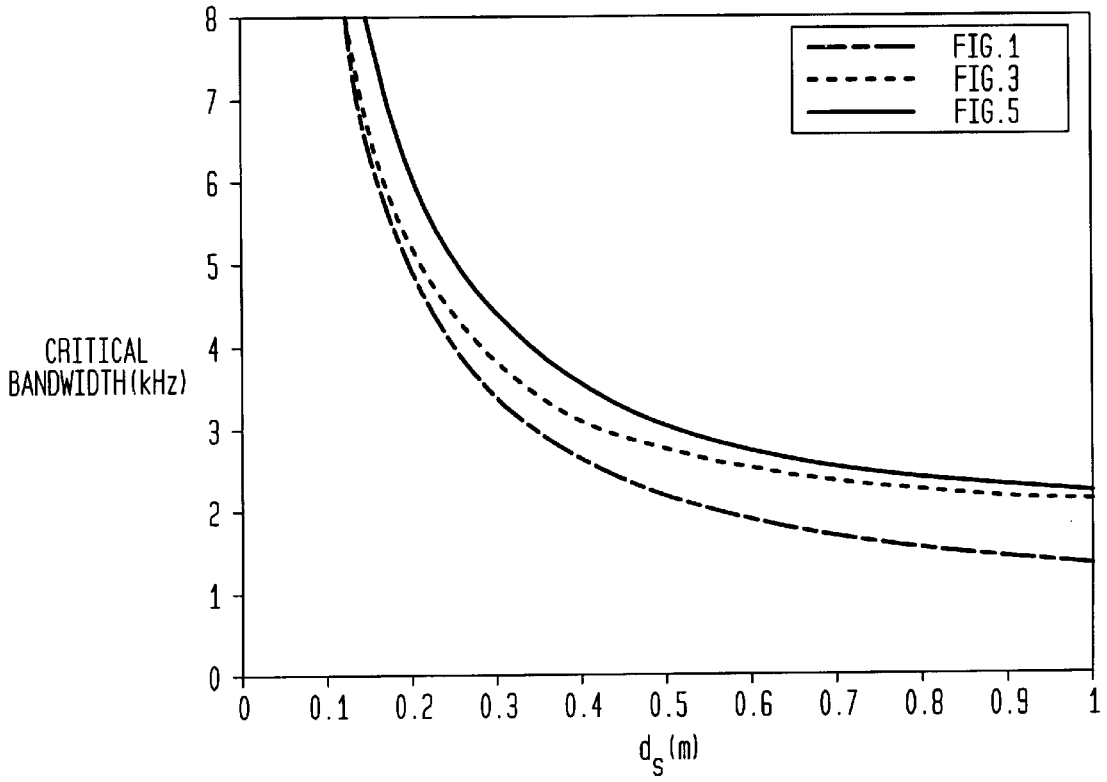
FIG. 6 is a graph of the critical bandwidth of various crosstalk cancelers as a function of loudspeaker spacing.

The gain in critical bandwidth achieved by the arrangement of FIG. 5 is illustrated in FIG. 6, which shows the critical bandwidth as a function of loudspeaker spacing for a symmetric loudspeaker arrangement (as in FIG. 1), an asymmetric arrangement (as in FIG. 3) and the arrangement of FIG. 5, with $Y_1$=10 cm. (A head distance of 0.5 m is used.) As shown in FIG. 6, the arrangement of FIG. 5 provides an additional 1 kHz of critical bandwidth over the conventional symmetrical arrangement of FIG. 1. This improved performance is true over the complete range of loudspeaker spacings ($d_s$) shown.

Similarly, the inter-aural path difference can be decreased by moving the loudspeaker 1 forward of loudspeaker 2. Such a configuration (not shown) would achieve similar results to that of FIG. 5.

Figure 7:
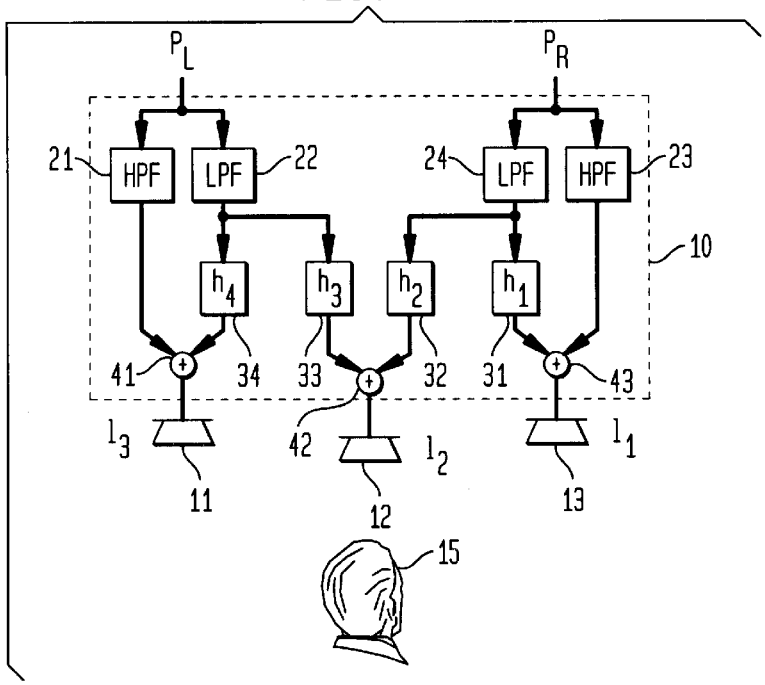
FIG. 7 is a block diagram of an exemplary embodiment of a crosstalk cancellation system, with three loudspeakers, in accordance with the present invention.

FIG. 7 shows a block diagram of an exemplary embodiment of a crosstalk cancellation system in accordance with the present invention. The system of FIG. 7 comprises a signal processing circuit 10 and three loudspeakers, 11, 12 and 13. The center loudspeaker 12 is displaced forward of the left and right loudspeakers 11 and 13, towards the listener 15. By analogy to the configuration of FIG. 5, the center loudspeaker 12 can alternately be displaced back of the left and right loudspeakers 11 and 13, away from the listener.

In the embodiment of FIG. 7, the processing circuit 10 comprises a high-pass filter (HPF) 21 and a low-pass filter (LPF) 22 whose inputs are coupled to a left channel signal input. A HPF 23 and a LPF 24 are also included for the right channel, with inputs coupled to a right channel signal input. The outputs of the HPFs 21 and 23 are coupled, respectively, to inputs of summing points 41 and 43 whose outputs drive the left and right loudspeakers 11 and 13, respectively. The output of LPF 22 is coupled to inputs of filters 33 and 34. The output of LPF 24 is coupled to inputs of filters 31 and 32. The output of filter 34 is provided to a second input of the summing point 41 and the output of filter 31 is provided to a second input of the summing point 43. The outputs of filters 32 and 33 are provided to a summing point 42, whose output drives the center loudspeaker 12. A workstation is available from Lake DSP of Sydney, Australia. The circuit 10 can be implemented with a variety of commercially available digital signal processors (DSP) or on a personal computer.

At low frequencies (e.g., below about 5 kHz), the exemplary system of FIG. 7 uses the geometry of FIG. 5 for each channel, thus providing additional robustness to head movement. At high frequencies (e.g., above about 5 kHz), the left channel is fed directly to the left loudspeaker 11 and the right channel is fed directly to the right loudspeaker 13. As such, the signal processing circuit 10 of FIG. 7 does not perform crosstalk cancellation at high frequencies. Any form of crosstalk cancellation will be non-robust at high frequencies (unless prohibitively close loudspeaker spacings are used). Also, at high frequencies (e.g., above about 6 kHz) the shadowing effect of the head comes into play and helps to separate left and right channels. This compromise between robust crosstalk cancellation at low frequencies and basic stereo reproduction at high frequencies represents a good trade-off between realistic 3D audio presentation and practical constraints.

For an exemplary desktop audio system in accordance with the present invention, typical dimensions would be: a head distance of 0.5 m; loudspeaker spacings (between 11 and 12 and between 12 and 13) of 0.25 m; and the outside loudspeakers 11 and 13 set 0.1 m back from the center loudspeaker 12.

Figure 8A:
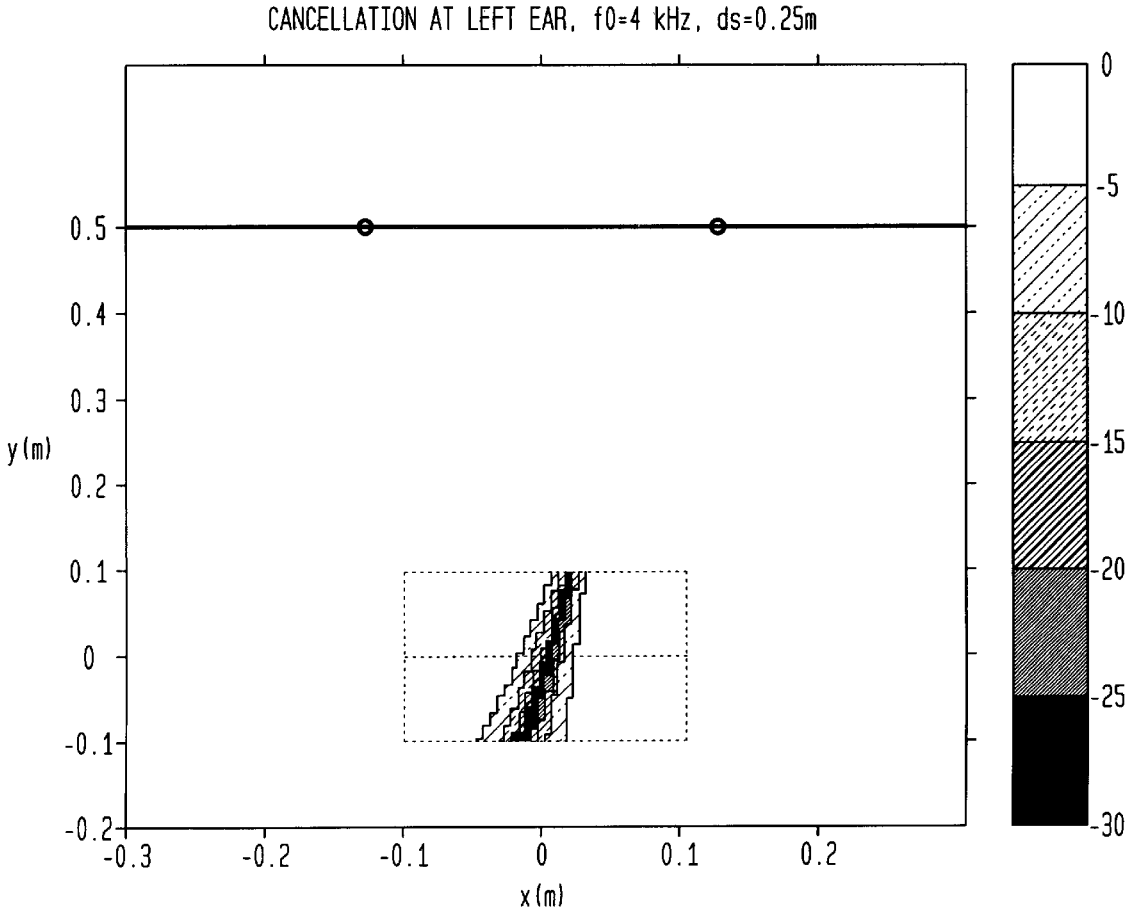
FIGS. 8A and 8B are graphs of the amount of cancellation with head movement for a conventional crosstalk canceler and a crosstalk cancellation system in accordance with the present invention, respectively.
Figure 8B:
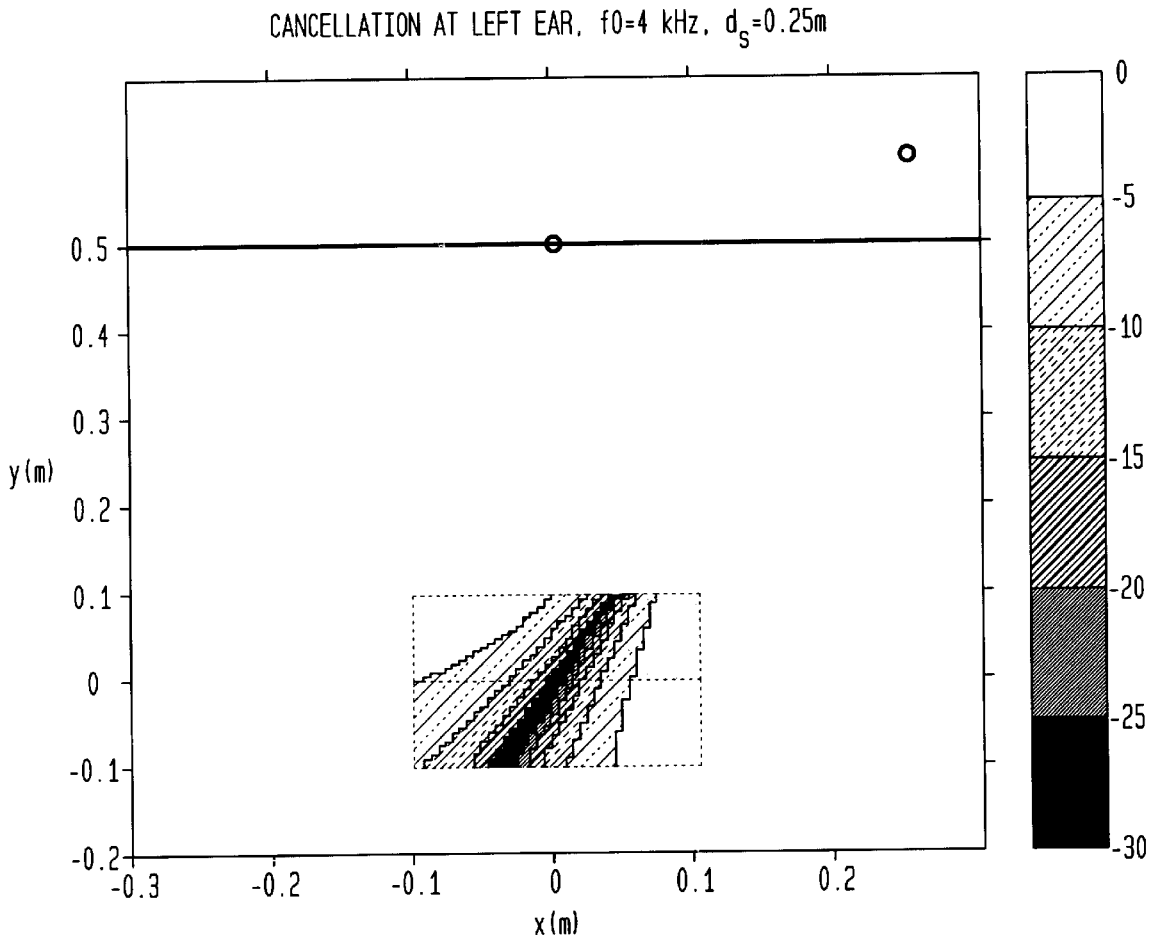

FIGS. 8A and 8B show simulation results which illustrate the increase in robustness afforded by the system of the present invention. For a conventional, symmetric crosstalk canceler arrangement such as that of FIG. 1 with a loudspeaker spacing of 0.25 m and the design head positioned 0.5 m from the loudspeaker centerline, FIG. 8A shows the amount of cancellation achieved at the left ear (measured in dB) for a frequency of 4 kHz, as the head moves in steps of 1 cm within the dotted region. The loudspeaker positions are denoted in FIG. 8A by the open circles. A spherical head model is used for the HRTFs, which is more realistic than a delay-only model. (A spherical head model is described in C. P. Brown et al., "An efficient HRTF model for 3-D sound", in *Proc. IEEE Workshop on Applicat. of Signal Processing to Audio and Acoust.* (WASPAA-97), New Paltz, N.Y., October 1997.) The crosstalk canceler is designed to give perfect cancellation at (x,y)=(0,0), the design head position.

Figure 1:
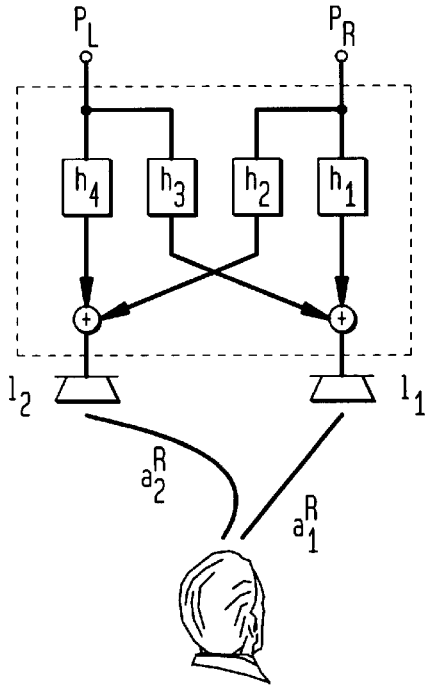
FIG. 1 is a block diagram of a conventional crosstalk canceler.
Figure 2:
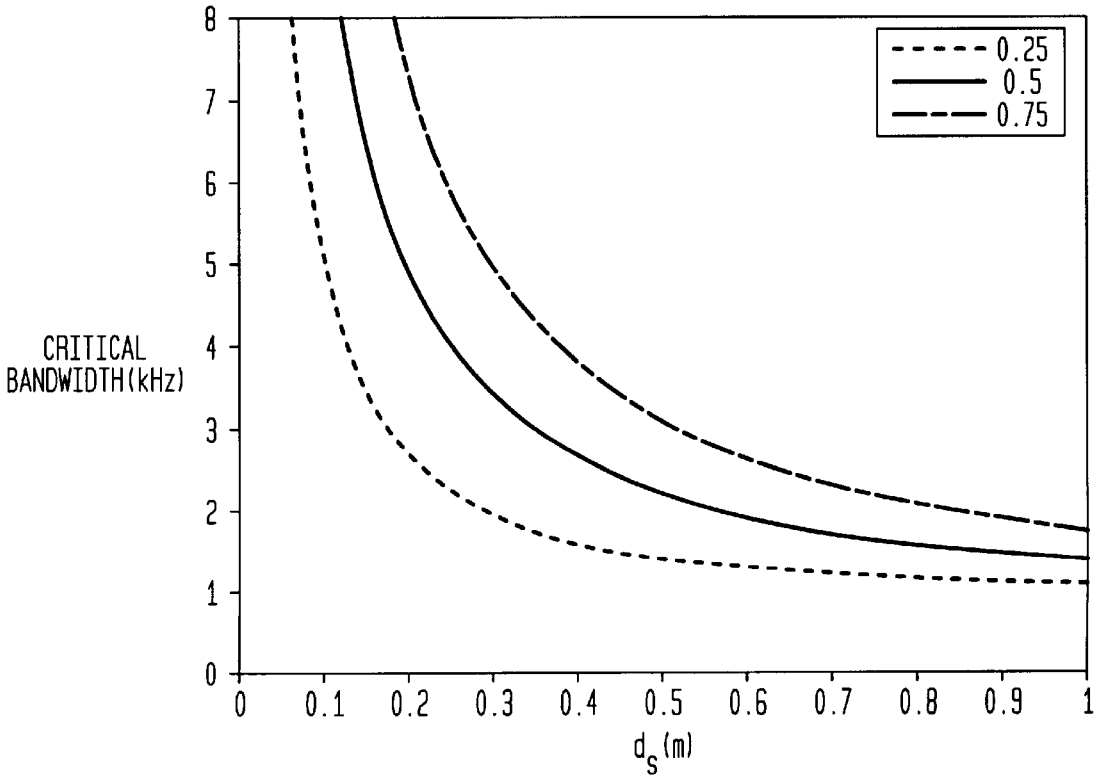
FIG. 2 is a graph of the critical bandwidth of a conventional crosstalk canceler as a function of loudspeaker spacing.

As can be seen in FIG. 8A, with the conventional system of FIG. 1, cancellation of 10 dB or better is only achieved within about a 2 cm radius of the design head position.

FIG. 8B shows the results for an arrangement in accordance with the present invention. Again, the loudspeaker positions are denoted by open circles. Comparing FIGS. 8A and 8B, it is clear that the proposed system provides a far larger region in which crosstalk cancellation of at least 10 dB is achieved.

Figure 9A:
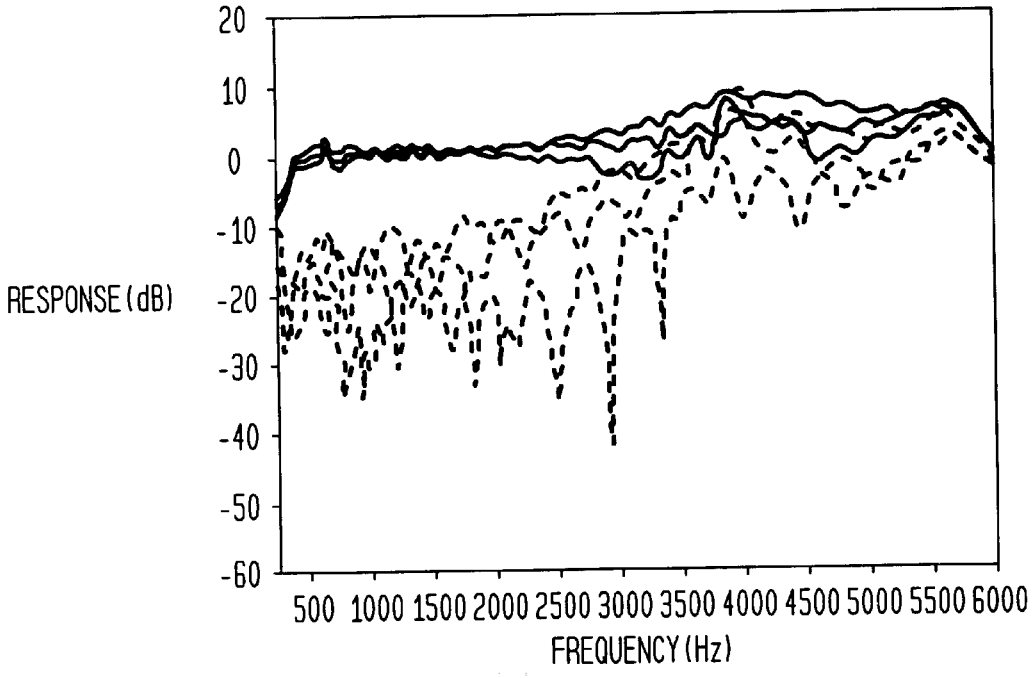
FIGS. 9A and 9B are graphs of the amount of cancellation for a conventional crosstalk canceler and a crosstalk cancellation system in accordance with the present invention, respectively.
Figure 9B:
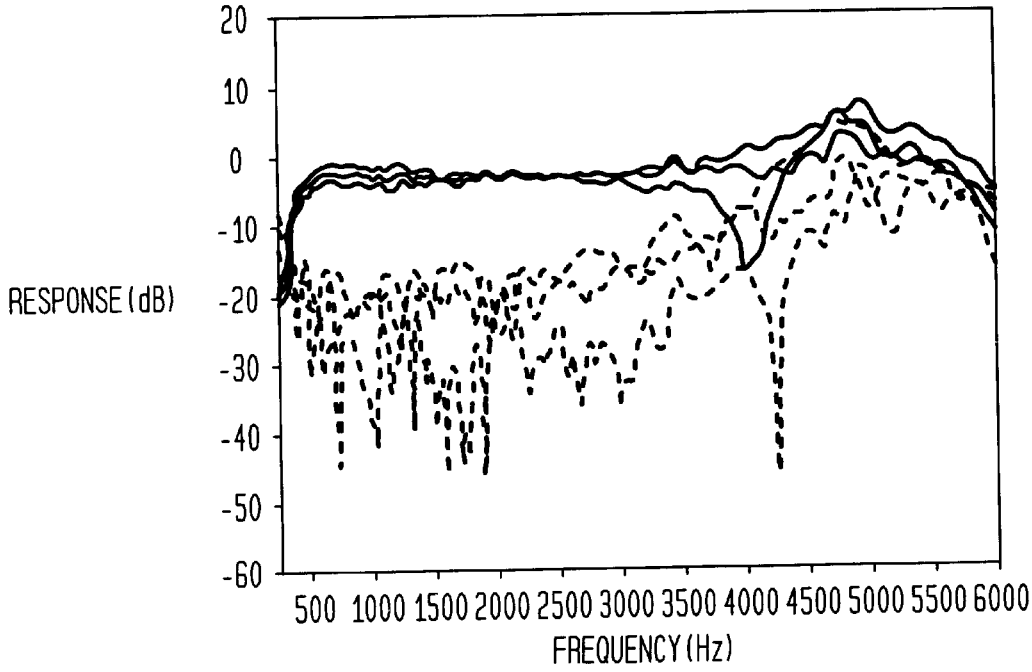

FIGS. 9A and 9B show the results of testing performed in an anechoic chamber with the conventional arrangement of FIG. 1 and with a system in accordance with the present invention, respectively. For applications such as desktop audio in which the direct sound field is dominant, the anechoic test environment is sufficiently realistic.

Two omni-directional microphones spaced 0.175 m apart were used to measure the ear responses, although no dummy head was used. For each system (i.e., conventional and proposed), the impulse responses (IRs) between the loudspeakers and the ears were measured for the design head position. Using these measured IRs, crosstalk cancellation filters were designed to satisfy Eq. 3.

The resulting ear responses after crosstalk cancellation are shown in FIGS. 9A and 9B, for three different head positions. The head positions are 0 cm (i.e., the design position where the IRs were measured), 2 cm right of the design position, and 5 cm right of the design position. FIGS. 9A and 9B show the measured frequency responses of the right channel (solid lines) and left channel (dashed lines) with microphone displacements of 0 cm, 2 cm, and 5 cm from the design position, for a conventional system (9A) and for a system in accordance with the present invention (9B).

As shown in FIGS. 9A and 9B, the system of the present invention provides effective cancellation up to about 4 kHz, even when the head position is moved 5 cm from its design position. However, the conventional system is effective only up to about 3 kHz.

Figure 10:
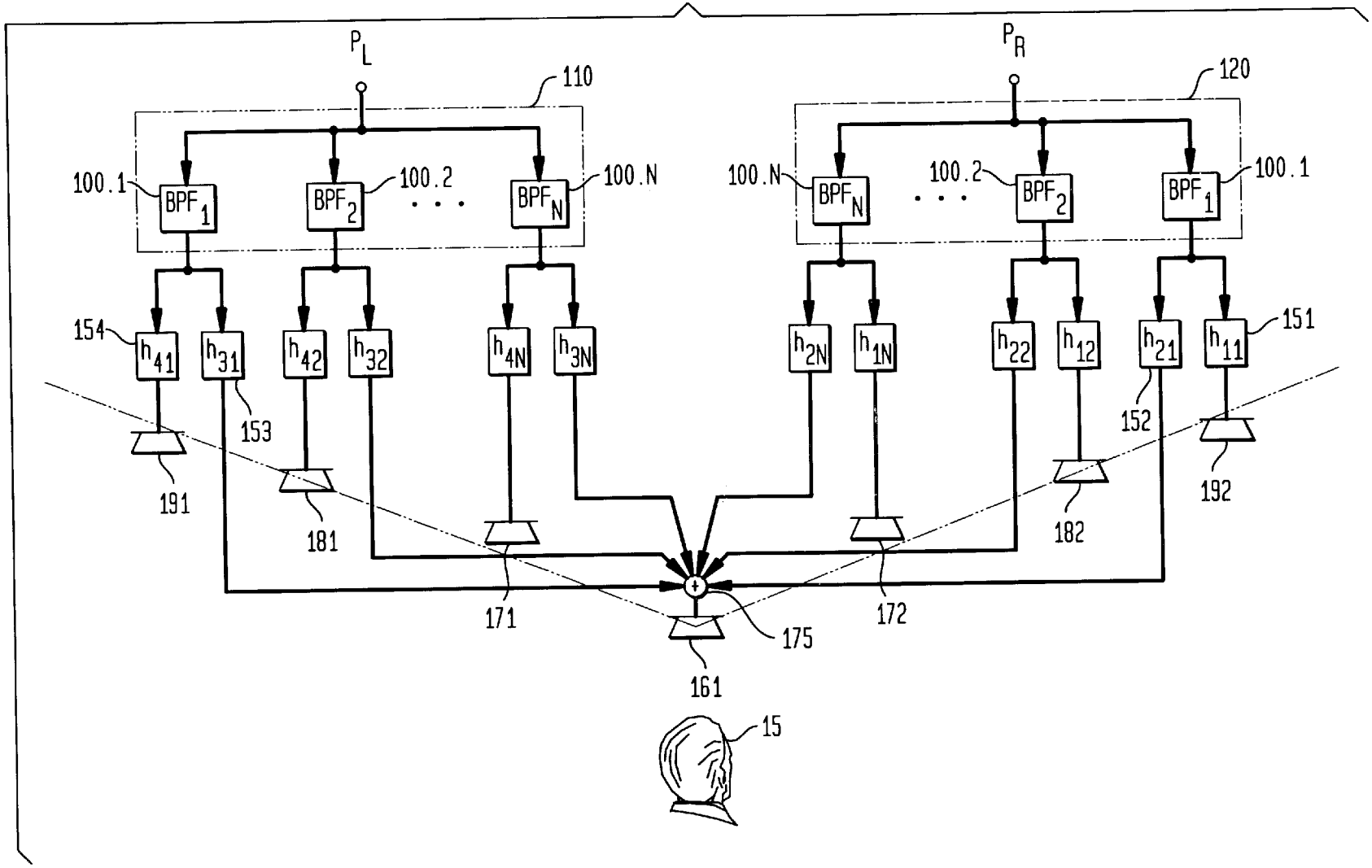
FIG. 10 is a block diagram of an exemplary embodiment of a crosstalk cancellation system, with 2N+1 loudspeakers, in accordance with the present invention.

FIG. 10 shows a block diagram of an exemplary embodiment of a crosstalk cancellation system in accordance with the present invention, which uses 2N+1 loudspeakers. A predetermined number of speakers may be used depending on the overall bandwidth range and the range of allowable condition numbers for the acoustic transfer matrix A. The system of FIG. 10 comprises signal processing circuitry and an odd number of loudspeakers, 161, 171, 172, 181, 182, 191, 192. In the exemplary embodiment of FIG. 10, the loudspeakers are arranged in a "V" configuration, with the center loudspeaker 161 being closest to the listener 15 and the loudspeakers to the left and right of the center loudspeaker being progressively further back from the listener the farther they are from the center loudspeaker. As with the embodiment of FIG. 7, the loudspeakers can also be arranged in an inverted "V" configuration, with the center loudspeaker 161 being located furthest back from the listener 15.

In the embodiment of FIG. 10, the processing circuitry comprises two banks of band-pass filters (BPF) 110 and 120 whose inputs are coupled to a left channel signal input $p_L$ and a right channel signal input $p_R$. Each BPF bank 110 and 120 comprises N BPFs 100.1–100.N. The center frequencies and bandwidths of the BPFs 100.1–100.N are selected to maintain the condition number of the acoustic transfer matrix A to below a prescribed value. The BPFs 100.1–100.N of the filter bank 110 have similar characteristics to the corresponding BPFs 100.1–100.N of the filter bank 120. The output of each BPF 100.N of the filter bank 110 is coupled to filters $h_{4N}$ and $h_{3N}$ and the output of each BPF 100.N of the filter bank 120 is coupled to filters $h_{2N}$ and $h_{1N}$. The transfer functions of the filters $h_{1N}$, $h_{2N}$, $h_{3N}$, and $h_{4N}$ are determined in accordance with Eq. 1, for the corresponding BPF center frequencies or weighted frequency average over the band.

The left and right speakers can be thought of as being arranged in pairs, e.g., 171 being paired with 172, 181 being paired with 182, and 191 being paired with 192, with the speakers of each pair being located substantially the same distance from the listener 15 and operating in the same frequency band, as determined by the BPFs 100.1–100.N. The optimal spacing $d_s$ between the left and right loudspeakers of a given pair is selected so as to minimize the condition number of the acoustic transfer matrix A for the BPF center frequency corresponding to the pair of loudspeakers.

LPF 22 is coupled to inputs of filters 33 and 34. The output of LPF 24 is coupled to inputs of filters 31 and 32. The output of filter 34 is provided to a second input of the summing point 41 and the output of filter 31 is provided to a second input of the summing point 43. The outputs of filters 32 and 33 are provided to a summing point 42, whose output drives the center loudspeaker 12.

Figure 11:
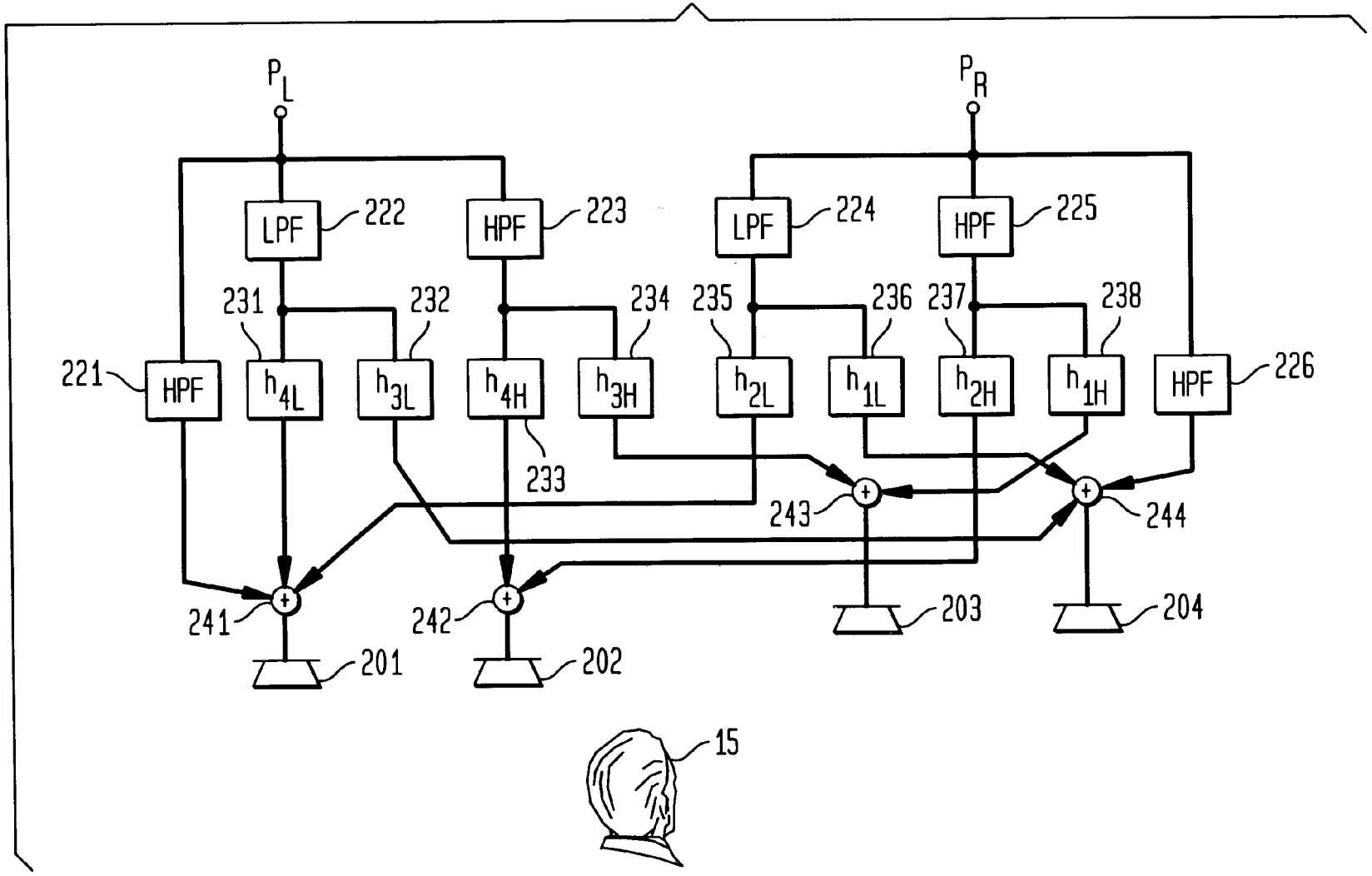
FIG. 11 is an exemplary embodiment of a crosstalk cancellation system with four loudspeakers, in accordance with the present invention.

FIG. 11 shows a block diagram of a further exemplary embodiment of a crosstalk cancellation system with an even number (e.g., four) of loudspeakers 201–204. By appropriately selecting the values of the filters 231–238, the system of FIG. 11 can accommodate positions of the listener 15 that are not centered with respect to the arrangement of loudspeakers. In an exemplary embodiment of the present invention, these values may be determined by measurement of the acoustic transfer matrix A or by using a physical model of the acoustic system.

What is claimed is:

1. An acoustic crosstalk cancellation system for receiving a left channel signal input and a right channel signal input comprising:

a left speaker;

a right speaker;

a third speaker located between the left speaker and the right speaker;

a fourth cancellation filter coupled to the left channel signal input and the third speaker;

a third cancellation filter coupled to the left channel signal input and the third speaker;

a second cancellation filter coupled to a right channel signal input and the third speaker;

a first cancellation filter coupled to the right channel signal input and the right speaker;

wherein the second cancellation filter performs cancellation of crosstalk from the right channel to a left ear of a listener using the third speaker, and the third cancellation filter performs cancellation of crosstalk from the left channel to a right ear of the listener using the third speaker.

2. The acoustic crosstalk cancellation system according to claim 1, further comprising:

a first high-pass filter coupled to the left channel signal input and the left speaker;

a first low-pass filter coupled to the left channel signal input and the fourth and third cancellation filters;

a second high-pass filter coupled to the right channel signal input and the right speaker; and a second low-pass filter coupled to the right channel signal input and the first and second cancellation filters.

3. The acoustic crosstalk cancellation system according to claim 1 wherein the third speaker is arranged a predetermined distance closer to the listener from an imaginary line drawn between the left and right speakers.

4. The acoustic crosstalk cancellation system according to claim 1 wherein the third speaker is arranged a further predetermined distance away from the listener from an imaginary line drawn between the left and right speakers.

5. The acoustic crosstalk cancellation system according to claim 1, further comprising:

a first high-pass filter coupled to the left channel signal input and the left speaker;

a first low-pass filter coupled to the left channel signal input and the fourth and third cancellation filters;

a second high-pass filter coupled to the right channel signal input and the right speaker;

a second low-pass filter coupled to the right channel signal input and the first and second cancellation filters; and wherein the third speaker is arranged a predetermined distance closer to the listener from an imaginary line drawn between the left and right speakers.

* * * * *